US005778292A

United States Patent [19]

Arends et al.

[11] Patent Number: 5,778,292

[45] Date of Patent: Jul. 7, 1998

[54] METHOD AND DEVICE FOR CONTROLLING A SLEEP-MODE OF AN IMAGE FORMING APPARATUS

[75] Inventors: Antonius Henricus Arends; Marijn Wilhelmus Petrus Gelten, both of Eindhoven, Netherlands

[73] Assignee: Oce-Nederland B.V., Ma Venlo, Netherlands

[21] Appl. No.: 706,711

[22] Filed: Sep. 6, 1996

[30] Foreign Application Priority Data

Sep. 8, 1995 [EP] European Pat. Off. ..... 95202431

[51] Int. Cl.[6] ..... G03G 15/16

[52] U.S. Cl. ..... 399/307; 399/70; 219/216

[58] Field of Search ..... 399/66, 70, 302, 399/307, 308; 219/216

[56] References Cited

U.S. PATENT DOCUMENTS

| | | | |
|---|---|---|---|
| 3,790,747 | 2/1974 | Klavsons et al. . | |
| 3,893,761 | 7/1975 | Buchan et al. . | |
| 3,923,392 | 12/1975 | Buchan et al. . | |
| 3,947,113 | 3/1976 | Buchan et al. . | |
| 4,430,412 | 2/1984 | Miwa et al. | 430/126 |
| 4,453,820 | 6/1984 | Suzuki | 399/308 |
| 4,455,079 | 6/1984 | Miwa et al. | 399/308 |
| 4,719,489 | 1/1988 | Ohkubo et al. . | |
| 5,041,718 | 8/1991 | d'Hondt et al. | 219/255 |
| 5,241,349 | 8/1993 | Nagasaka . | |
| 5,307,132 | 4/1994 | Tsuchiya | 399/70 |
| 5,448,339 | 9/1995 | Kokaji et al. | 399/69 |
| 5,489,761 | 2/1996 | Aslam et al. | 219/216 |
| 5,530,534 | 6/1996 | Dalal | 399/307 |

FOREIGN PATENT DOCUMENTS

| | | |
|---|---|---|
| 0528467 | 7/1992 | European Pat. Off. . |
| 0638437 | 2/1995 | European Pat. Off. . |
| 4-018583 | 1/1992 | Japan . |
| 5-289537 | 11/1993 | Japan . |
| 7-114296 | 2/1995 | Japan . |

*Primary Examiner*—Robert Beatty
*Attorney, Agent, or Firm*—Birch, Stewart, Kolasch & Birch, LLP

[57] ABSTRACT

Method and Apparatus for controlling the sleep-mode of an image forming apparatus includes a movable and heatable element, a drive member for driving the element and a heating member for heating the element while it is being driven by said drive member. The drive member and heating member are controlled to keep the heatable element at a temperature below its normal operating temperature in order to reduce power consumption in the sleep-mode. The drive member and said heating member are energized and de-energized cyclically and the heating member, when switched on, is energized with full power. The movable and heatable element preferably is an intermediate belt for heat transferring/fixing a developed image to a recording medium.

25 Claims, 2 Drawing Sheets

METHOD AND DEVICE FOR CONTROLLING A SLEEP-MODE OF AN IMAGE FORMING APPARATUS

BACKGROUND OF THE INVENTION

1. Field of the Invention

The invention relates to a method for controlling the sleep-mode of an image forming apparatus comprising a movable and heatable element, drive means for driving the element and heating means for heating said element while it is being driven by said drive means, wherein said drive means and heating means are controlled to keep the heatable element at a temperature below a predetermined, normal operating temperature in order to reduce power consumption in the sleep-mode, and to an image forming apparatus adapted to carry out this method.

More particularly, the invention relates to a image forming apparatus such as a copier, a laser printer or the like, in which the movable and heatable element is used for heat-transferring a developed toner image onto an image recording medium such as copying paper or onto an intermediate image carrier and/or for heat-fixing the toner image on the recording medium. In an apparatus in which the image fixing process involves pre-heating of the image recording medium, the movable and heatable element may also be a conveying member such as a roller or a belt by which the image recording medium is pre-heated and conveyed to the fixing station.

2. Description of Background Art

U.S. Pat. No. 5,241,349 discloses an image forming apparatus which includes a fixing roller as the heatable and movable element. This apparatus further includes a feed-back temperature control system for supplying a variable current to the heating means so as to keep the fixing roller at its normal operating temperature as long as the apparatus is in the stand-by mode. In order to save energy when the image forming apparatus is not being used for a longer period of time, the control system automatically switches to a sleep-mode when a certain time interval has lapsed after the apparatus has been used for the last time. In the sleep-mode the target value for the temperature of the fixing roller is reduced to a level below a predetermined, normal operating temperature, so that thermal energy losses are reduced. From the viewpoint of energy consumption, the target value for the temperature in a sleep-mode should be set as small as possible. But on the other hand, when the temperature of the fixing roller in the sleep-mode becomes too small, it takes more time to re-heat the fixing roller to its normal operating temperature when the apparatus is switched back from the sleep-mode to the operative mode. Thus, a user who wants to make another copy when the apparatus is in the sleep-mode, is faced with the inconvenience that he has to wait some time before the apparatus is again ready for printing.

Depending on the construction of the apparatus, the heating means may not be capable of heating the movable and heatable element, e.g. a roller or a belt, in its entirety, so that the roller or belt must be driven to move past the heating means in order to achieve a sufficiently uniform temperature distribution. Image forming apparatus of this type are described for example in EP-A1-0 528 467 and EP-A1-0 638 437. In these apparatus the heatable and movable element is an endless belt which serves as intermediate image carrier and is passed over a number of rollers to receive a developed image from a photoconductive belt in an image transfer station and then to transfer and fix this image onto copying paper in a transfer and fixing station which will be referred to as a "transfuse station" hereinafter. Heating means such as heating rollers or infrared irradiating lamps are arranged in the path of movement of the endless belt. When the sleep-mode control system discussed above is applied to this type of apparatus, the belt must be constantly driven during the sleep-mode operation in order to achieve a substantially uniform temperature of the belt.

SUMMARY AND OBJECTS OF THE INVENTION

It is an object of the present invention to provide a sleep-mode control method and an image forming apparatus wherein the power consumption during sleep-mode operation can be reduced further without significantly increasing the time needed for re-establishing the normal operating temperature of the movable and heatable element at the end of the sleep-mode.

In a method and apparatus according to the invention, this object is achieved by providing a drive means and a heating means which are energized intermittently, and the heating means, when switched on, is energized with full power.

By energizing the heating means only intermittently, the average power consumption can be reduced, even though the heating means is energized with full power in the periods in which it is switched on. This has the advantage, that the total time during which the movable and heatable element is actually heated and in which the drive means must be operative, amounts only to a small fraction of the overall duration of the sleep-mode operation, so that the drive means is kept inoperative most of the time, and the power consumption of the drive means can be reduced significantly.

In addition, it will be noted that the temperature distribution along the path of movement of the movable element will normally be non-uniform. Thus, as long as the element is moving, it functions as a heat transfer medium which constantly carries away thermal energy from the hot portions to the cooler ones and thus contributes to increased thermal losses. Since, according to the invention, the heatable and movable element is moved only during comparatively short intervals, these losses are minimized as well.

When the heatable element is not moving, i.e. during the periods in which the heaters are de-energized, some portions of the element may cool down more rapidly than other portions, where the surrounding components of the apparatus provide for a better thermal insulation. Thus, the non-uniformity of the temperature distribution of the element may increase. This, however, is not necessarily a drawback, since it is possible to use the hotter portions of the element for making the first copy when the apparatus is used again.

In a preferred embodiment the length of the time periods in which the heating means and the drive means are energized in the sleep-mode and the length of the intervening periods in which the heating means and drive means are de-energized, are fixed by means of a timing control system, irrespective of the actual temperature of the element. This has the advantage that the manufacturer can guarantee that the power consumption in the sleep-mode will not exceed a certain limit, irrespective of the actual operating conditions such as environmental temperature, heat efficiency of the heaters (which may be subject to aging) and the like.

Normally, the timings will be set in such a manner that, when the apparatus is switched from the stand-by mode to the sleep-mode, the time-average of the temperature of the heatable element will drop below the operating temperature.

However, since the temperature losses become smaller when the average temperature of the element decreases, the average temperature will gradually approach a stable equilibrium. When the apparatus is switched back from the sleep-mode to the operative mode, this equilibrium temperature will determine the time which is needed for recovering the operating temperature in the worst case. However, when the apparatus has been in the sleep-mode only for a comparatively short time, the temperature of the heatable element will still be higher, so that the time required for recovering the operating temperature will be shorter.

The frequency at which the heating means and the drive means are switched on and off in the sleep-mode should be selected sufficiently high in order to avoid the situation wherein the minimum values to which the temperature drops at the end of the de-energized periods will not become unreasonably small. A higher switching frequency will result in a smoother temperature curve. On the other hand, an extremely high switching frequency may lead to a drawback wherein components such as relays, switches and the like, which are used for switching the heating means and the drive means on and off, are activated very frequently and may become worn-out before the expected life-time of the apparatus.

While the drive means are only switched on and off in the simplest case, it is possible to control the drive means in such a manner that, during the heating periods in the sleep-mode, the movable element is moved at a speed which is lower than the normal operating speed, so that energy consumption of the drive means can be reduced further.

When the movable and heatable element is an endless belt or a roller, it is preferable to set the speed of this element and/or the length of the heating interval such that the element will perform an integral number of revolutions during each heating period, so that each portion of the belt or roller moves past the heaters for the same number of times.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
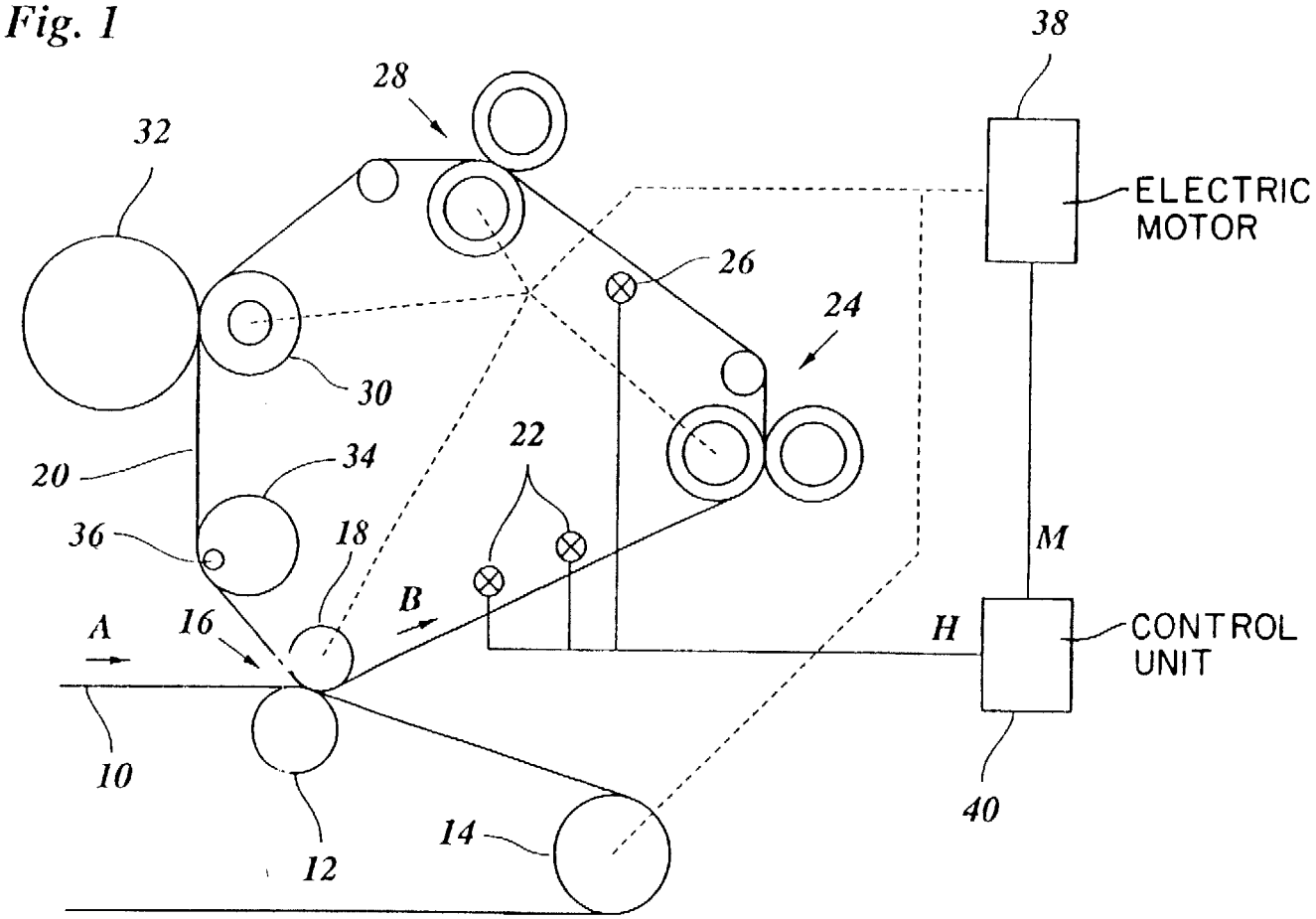
FIG. 1 is a diagram of the essential parts of a duplex copying machine to which the invention is applicable.

The copying machine shown in FIG. 1 comprises an endless photoconductive belt 10 which is passed, among others, around rollers 12, 14 and can be driven in the direction of arrow A. A latent electrostatic charge image is formed on the photoconductive belt 10 in an image forming station (not shown) and is then developed with toner powder in a developing station (not shown). In a transfer station 16 the belt 10 passes through a nip between the roller 12 and another roller 18 and is brought into pressing contact with and endless intermediate belt 20 that is made of or covered with a soft, resilient and heat resistant material such as silicon rubber. Here, the toner image is transferred from the belt 10 onto the intermediate belt 20 by forces of adhesion.

The intermediate belt 20 is guided over a number of rollers and is driven in the direction of arrow B. From the transfer station 16 the intermediate belt 20 carrying the toner image moves past a number of heaters 22 which may be formed for example by infrared lamps and by which the temperature of the intermediate belt 20 is raised above the softening temperature of the toner powder, so that the toner image becomes sticky.

The intermediate belt 20 then passes through the nip between two rollers which form a first transfuse station 24 where the intermediate belt 20 can be brought into pressing contact with a sheet of receiving material so that the softened toner image is transferred to and simultaneously fixed on the receiving material by heat fusion.

Another heater 26 and a second transfuse station 28 are arranged along the path of the endless belt 20 downstream of the first transfuse station 24. The nips of the respective pairs of rollers in the first and second transfuse stations 24, 20 can be opened and closed independently of each other. The first transfuse station 24 is used for transferring and fixing an image on a first side of a sheet of receiving material. When a duplex copy is to be made, the sheet is guided to the second transfuse station 28 where another toner image, that has been transferred to the intermediate belt 20 from the photoconductive belt 10, is fixed on the second side of the sheet.

Downstream of the second transfuse station 28 the intermediate belt 20 passes through a nip between a guide roller 30 and a cleaning roller 32 for removing residual toner from the surface of the belt. Between the cleaning roller 32 and the transfer station 16 the intermediate belt 20 passes over a non-rotating tensioning drum 34 which includes a heat sensor 36 (e.g. an NTC thermistor) for detecting the temperature of the belt.

In the shown embodiment the photoconductive belt 10 and the intermediate belt 20 are synchronously driven by means of an electric motor 38 (main motor) which is mechanically coupled to a number of rollers associated with the belts 10, 20, as is symbolized by dashed lines in FIG. 1.

The operation of the copying machine is controlled by a control unit 40 which may include a microcomputer and which delivers among others a current signal M to the motor 38 for driving the same and a current signal H to the heaters 22, 26 for controlling the amount of heat per time unit generated by these heaters.

In the shown embodiment, the current signal M for the motor 38 is an ON/OFF signal, whereas the current signal H applied to the heaters 22, 26 is an analog signal, so that the heating power may be varied steplessly.

Figure 2:
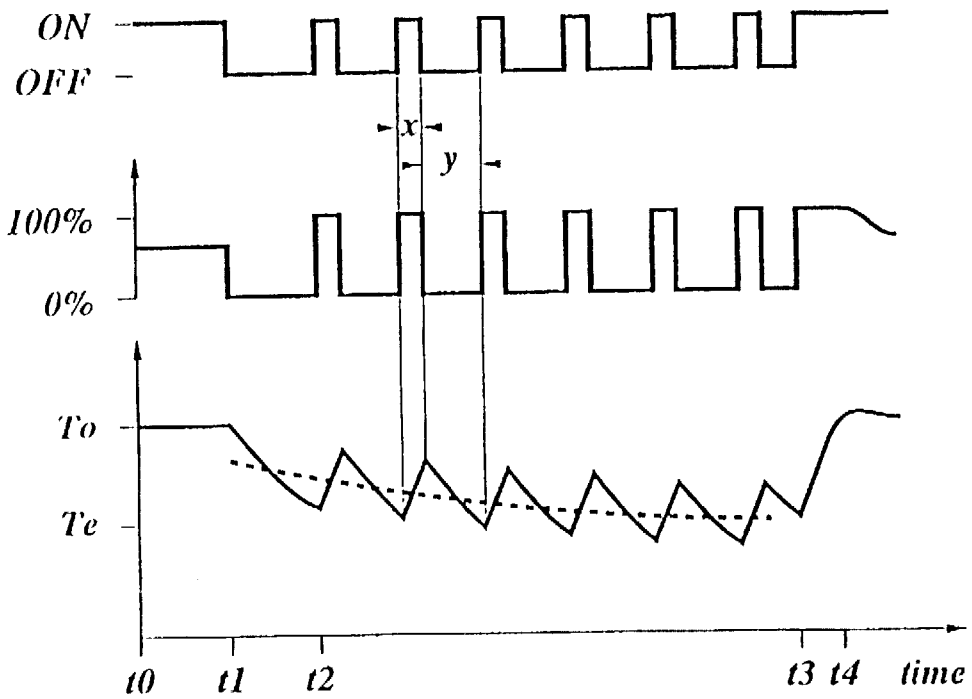
FIG. 2 illustrates the time development of signals occurring in the machine of FIG. 1 and of the temperature of an intermediate image carrier thereof during a sleep-mode period.

When the copying machine is operating both the belts 10 and 20 are driven continuously, and when the copying machine is in the stand-by mode the intermediate belt 20 is driven continuously whereas the photoconductive belt 10 stands still with the nip between the belts being opened. When the copying machine is operating in the stand-by mode, the control unit 40 controls the heaters 22, 26 via the current signal H in a feedback control loop, e.g. PID control, on the basis of a signal received from the heat sensor 36. When the machine is in the stand-by mode and has not been used for a preselectible time period, the control unit 40 automatically switches to a sleep-mode and functions as sleep-mode control means for reducing power consumption of the machine. Such a sleep-mode control process is illustrated in FIG. 2.

The upper curve (M) shows the time development of the current signal M for the drive means, i.e. the motor 38. The curve (H) illustrates the time changes of the current signal H applied to the heaters 22, 26, measured as a percentage of the maximally possible current intensity and heating power. The lower curve (T) illustrates the time changes of the temperature of the intermediate belt 20 as measured for example by means of the heat sensor 36.

In the time interval between t0 and t1 the machine is in the stand-by mode. Thus, the drive signal M for the motor is ON, the current signal H for the heaters has a value somewhere between 0% and 100% to keep the temperature of the intermediate belt 20 close to the operating temperature To.

The machine is switched to the sleep-mode at t1. At this instant, the signal M changes to OFF and the signal H drops to 0%, i.e. the heaters are switched off.

Throughout the sleep-mode the nip between the rollers 12 and 18 of the transfer station 16 is kept open whereas the roller nips in the transfuse stations 24 and 28 and the nip between the roller 30 and the cleaning roller 32 are constantly kept closed.

Since the heaters have been switched off, the temperature of the intermediate belt 20 gradually decreases, as is shown by the curve T (shown in solid lines). After a predetermined time interval or when a predetermined temperature value is reached, at the time t2, the heaters and the motor are switched on for a fixed time interval of length x. During this time interval the heaters are energized with full power, i.e. the signal H is at 100%, and the belt 20 is driven in order to achieve a substantially uniform temperature distribution over the length of the belt 20. As a result of the high heating power the temperature of the belt 20 increases with a rather steep slope. The length of the time interval between t2 and t1 is fixed in accordance with the power of the heaters and the length x of the time interval during which the heaters are energized, such that the temperature which the belt reaches at the end of the heating period (i.e. at the first peak of the curve in FIG. 2) will in no case be higher than the operating temperature To. Then, the motor and the heaters are switched off for a time interval with a fixed length y, and then the ON- and OFF-cycles of the signals M and H are repeated as long as the sleep-mode is maintained.

The cycle time x+y determines the amplitude of the temperature fluctuations around the average temperature (indicated by the curve in broken lines in FIG. 2). By fixing the duty ratio x/(x+y), the average power consumption of the machine during the sleep-mode can be adjusted reliably.

In a practical example the nominal power consumption of each of the heaters 22, 26 (at full power) is 750 W. Taking tolerances into account, the power consumption will not be larger than 790 W for each heater, i.e. 2370 W for all three heaters. Thus, if the power consumption of the motor 38 is 100 W, the overall power consumption during the heating periods of the length x will be 2470 W. If x is fixed to 30 s and y is fixed to 270 s, then the duty ratio is 10 and the average power consumption of the heaters and the motor will be 274 W. Addition of the (constant) power consumption of 90 W of the control unit 40 gives 364 W as the total power consumption of the machine during sleep-mode. This value is safely below the limit value of 390 W recommended by the United States Environmental Protection Agency in its so-called "Energy Star Program."

Since the motor 38 is only driven intermittently, the average power consumption of the motor is only 10 W. By comparison, if the heaters were energized constantly with the signal H being reduced correspondingly, then the motor 38 would have to be driven all the time, resulting in a power consumption of 100 W. Thus, even if only the power consumption of the motor is taken into consideration, the energy savings amount to 90 W.

As can be seen in FIG. 2, the average temperature of the intermediate belt 20 gradually decreases during the sleep-mode (curve in broken lines) and approaches a stable equilibrium temperature Te. When the machine is switched back to the operative mode at t3, the PID control of the heaters is resumed and the belt is heated to recover its operating temperature To as quickly as possible. When the operating temperature is reached at t4, the signal H is automatically reduced in the course of PID control. In the practical example discussed above, the operating temperature To of the belt 20 is approximately 120° C. and the equilibrium temperature Te is reached after about 2 hours and amounts to approximately 98° C. The exact value of this temperature will of course be slightly influenced by the environmental temperature of the machine. When the machine is switched to the operative mode after two or more hours of sleep-mode operation, the time in which the belt is heated again to the operating temperature will be about 90 s on the average. This time (t4–t3) is subject to variations in the order of x, i.e. 30 s, depending on the position of the time t3 relative to the heating cycle. It is understood that these fluctuations can be reduced by setting the parameter x to a smaller value.

The temperatures indicated above are temperatures measured with the heat sensor 36, i.e. temperatures at the inner surface of the endless belt 20. However, the image transfer and fixing processes and the cleaning process are dependent on the temperature at the outer surface of the belt 20. It has been found that the temperature curve for the temperature at the outer surface of the belt is smoother than the curve shown in FIG. 2, due to the heat capacity of the belt which acts as a heat buffer. This means that the delay time after which the temperature of the outer surface of the belt is sufficient for making a copy after the time t3 will generally be shorter and subject to smaller fluctuations than indicated above.

In addition, it has been found that during the periods of the length y at which heating is suspended, the temperature distribution over the length of the belt becomes uneven, since some portions of the belt are cooled more than others. Immediately before a new heating period begins, the belt 20 has the highest temperature in the vicinity of the second transfuse station 28, and the temperature of the belt is lowest at the location between the heaters 22. During the heating period, while the belt is being driven, these temperature differences are gradually smoothened-out. Nevertheless, the non-even temperature distribution over the belt can be utilized for shortening the delay time for making the first copy after the time t3. To this end, the imaging process is timed such that the first image is transferred to a portion of the intermediate belt 20 where its temperature is comparatively high.

While a specific embodiment of the invention has been described above, it will occur to a person skilled in the art that this embodiment can be modified in various ways. Such variations are not to be regarded as a departure from the spirit and scope of the invention, and all such modifications as would be obvious to one skilled in the art are intended to be included within the scope of the following claims.

For example, while the signals M and H are switched on and off synchronously during the sleep-mode in the above embodiment, the heaters and the motor may be activated and deactivated at slightly different timings. Further, the intermediate belt 20 and the photoconductive belt 10 might be driven by separate motors. It may then be possible to drive only the intermediate belt 20 while the heaters are energized and to keep the photoconductive belt 10 constantly at rest, provided that the temperature of the belt 10 in the vicinity of the transfer station 16 does not become too large. Thus, the average power required for the drive means (motors) could be reduced further. Likewise, it would be possible to control the motor or motors with a variable current so that the speed and hence the energy consumption of the drive means can be reduced in comparison to the normal operating speed.

Finally, it will be noted that the invention is not only applicable to machines in which the heatable and movable element is the intermediate belt 20, but is also applicable to heatable and movable elements formed for example by a fixing roller.

What is claimed is:

1. A method for controlling the sleep-mode of an image forming apparatus comprising the following steps:

providing a movable and heatable element;

imparting movement to the movable element;

heating the movable element exclusively while it is moving;

controlling the movement and the heating to maintain the heatable element at a lower predetermined temperature relative to a normal operating temperature in order to reduce power consumption in the sleep-mode;

energizing the movement and the heating intermittently; and energizing the heating with full power when activated.

2. The method according to claim 1, wherein the heating and the imparting movement to the movable element are energized and de-energized cyclically, with energized periods of a fixed duration and de-energized periods of a fixed duration.

3. The heating according to claim 2, wherein the heating and the imparting movement to the movable element are switched off at the time when the machine is switched to the sleep-mode, and the time at which a first heating cycle begins is a predetermined time interval later than the time at which the machine has been switched to the sleep-mode.

4. The method according to claim 2, wherein the heating and the imparting movement to the movable element are switched off at the time when the machine is switched to the sleep-mode, and a first heating cycle begins when the temperature of the heatable element has dropped to a predetermined value.

5. An image forming apparatus comprising:

a movable and heatable element;

drive means for driving the movable element;

heating means for heating the movable element exclusively while the movable element is being driven by said drive means; and sleep-mode control means for controlling said drive means and heating means to keep the movable element at a temperature below a predetermined operating temperature in order to reduce power consumption in a sleep-mode of the apparatus;

said sleep-mode control means energizing the drive means and the heating means, intermittently, and the heating means, when switched on, is energized with full power.

6. The image forming apparatus according to claim 5, wherein said movable and heatable element is an endless belt.

7. The image forming apparatus according to claim 6, wherein said heating means includes at least one heat radiating member disposed near the path of said endless belt.

8. The image forming apparatus according to claim 6, wherein said endless belt is an intermediate belt arranged for receiving a toner image from a photoconductive member in a transfer station and for transferring and fixing the received toner image onto an image recording medium in a transfuse station.

9. The image forming apparatus according to claim 7, wherein said endless belt is an intermediate belt arranged for receiving a toner image from a photoconductive member in a transfer station and for transferring and fixing the received toner image onto an image recording medium in a transfuse station.

10. The image forming apparatus according to claim 5, including at least one heat sensor for detecting the temperature of the heatable and movable element and control means for varying the power supplied to the heating means in response to a signal received from said heat sensor, when the machine is not in the sleep-mode.

11. The image forming apparatus according to claim 6, including at least one heat sensor for detecting the temperature of the heatable and movable element and control means for varying the power supplied to the heating means in response to a signal received from said heat sensor, when the machine is not in the sleep-mode.

12. The image forming apparatus according to claim 7, including at least one heat sensor for detecting the temperature of the heatable and movable element and control means for varying the power supplied to the heating means in response to a signal received from said heat sensor, when the machine is not in the sleep-mode.

13. The image forming apparatus according to claim 8, including at least one heat sensor for detecting the temperature of the heatable and movable element and control means for varying the power supplied to the heating means in response to a signal received from said heat sensor, when the machine is not in the sleep-mode.

14. An image forming apparatus comprising:

a movable member for transferring an image to a receiving material;

drive means operatively connected to said movable member for driving said movable member;

heating means for selectively heating an element exclusively while the movable member is driven by said drive means; and sleep-mode control means for controlling said drive means and said heating means for maintaining the movable member at a temperature below a predetermined operating temperature in order to reduce power consumption in a sleep-mode of the apparatus;

said sleep-mode control means intermittently energizing the drive means and the heating means for a selected period of time and the heating means, when activated, is energized with full power.

15. The image forming apparatus according to claim 14, wherein said movable member is an endless belt.

16. The image forming apparatus according to claim 15, wherein said heating means includes at least one heat radiating member disposed near the path of said endless belt.

17. The image forming apparatus according to claim 15, wherein said endless belt is an intermediate belt arranged for receiving a toner image from a photoconductive member in a transfer station and for transferring and fixing the received toner image onto an image recording medium in a transfuse station.

18. The image forming apparatus according to claim 16, wherein said endless belt is an intermediate belt arranged for receiving a toner image from a photoconductive member in a transfer station and for transferring and fixing the received toner image onto an image recording medium in a transfuse station.

19. The image forming apparatus according to claim 14, including at least one heat sensor for detecting the temperature of the movable member and control means for varying the power supplied to the heating means in response to a signal received from said heat sensor, when the machine is not in the sleep-mode.

20. The image forming apparatus according to claim 15, including at least one heat sensor for detecting the temperature of the movable member and control means for varying the power supplied to the heating means in response to a signal received from said heat sensor, when the machine is not in the sleep-mode.

21. A method for controlling the sleep-mode of an image forming apparatus comprising the following steps:

providing a movable and heatable element;

imparting movement to the movable element;

heating the movable element while it is moving;

controlling the movement and the heating to maintain the heatable element at a lower predetermined temperature relative to a normal operating temperature in order to reduce power consumption in the sleep-mode;

energizing the movement and the heating intermittently;

energizing the heating with full power when activated;

said heating and imparting of movement to the movable element being energized and de-energized cyclically, with energized periods of a fixed duration and de-energized periods of a fixed duration.

22. An image forming apparatus comprising:

a movable and heatable endless belt element;

drive means for driving the movable endless belt element;

heating means for heating the movable endless belt element while the movable endless belt element is being driven by said drive means; and sleep-mode control means for controlling said drive means and heating means to keep the movable endless belt element at a temperature below a predetermined operating temperature in order to reduce power consumption in a sleep-mode of the apparatus;

said sleep-mode control means energizing the drive means and the heating means, intermittently, and the heating means, when switched on, is energized with full power;

said endless belt being an intermediate belt arranged for receiving a toner image from a photoconductive member in a transfer station and for transferring and fixing the received toner image onto an image recording medium in a transfuse station.

23. An image forming apparatus comprising:

a movable and heatable endless belt element;

drive means for driving the movable endless belt element;

heating means for heating the movable endless belt element while the movable endless belt element is being driven by said drive means, said heating means includes at least one heat radiating member disposed near the path of said endless belt;

sleep-mode control means for controlling said drive means and heating means to keep the movable endless belt element at a temperature below a predetermined operating temperature in order to reduce power consumption in a sleep-mode of the apparatus;

said sleep-mode control means energizing the drive means and the heating means, intermittently, and the heating means, when switched on, is energized with full power; and said endless belt being an intermediate belt arranged for receiving a toner image from a photoconductive member in a transfer station and for transferring and fixing the received toner image onto an image recording medium in a transfuse station.

24. An image forming apparatus comprising:

a movable endless belt member for transferring an image to a receiving material;

drive means operatively connected to said movable endless belt member for driving said movable member;

heating means for selectively heating an element while the movable endless belt member is driven by said drive means;

sleep-mode control means for controlling said drive means and said heating means for maintaining the movable endless belt member at a temperature below a predetermined operating temperature in order to reduce power consumption in a sleep-mode of the apparatus; said sleep-mode control means intermittently energizing the drive means and the heating means for a selected period of time and the heating means, when activated, is energized with full power;

said endless belt being an intermediate belt arranged for receiving a toner image from a photoconductive member in a transfer station and for transferring and fixing the received toner image onto an image recording medium in a transfuse station.

25. An image forming apparatus comprising:

a movable endless belt member for transferring an image to a receiving material;

drive means operatively connected to said movable endless belt member for driving said movable member;

heating means for selectively heating an element while the movable endless belt member is driven by said drive means, said heating means includes at least one heat radiating member disposed near the path of said endless belt;

sleep-mode control means for controlling said drive means and said heating means for maintaining the movable endless belt member at a temperature below a predetermined operating temperature in order to reduce power consumption in a sleep-mode of the apparatus;

said sleep-mode control means intermittently energizing the drive means and the heating means for a selected period of time and the heating means, when activated, is energized with full power;

said endless belt is an intermediate belt arranged for receiving a toner image from a photoconductive member in a transfer station and for transferring and fixing the received toner image onto an image recording medium in a transfuse station.

* * * * *